United States Patent [19]

Coyle et al.

[11] 4,320,371

[45] Mar. 16, 1982

[54] TRACTIVE SOLENOID DEVICE

[75] Inventors: Forrest E. Coyle, Penn Hills Township, Allegheny County; James W. Barkell, Jr., Penn Township, Westmoreland County, both of Pa.

[73] Assignee: Westinghouse Electric Corp., Pittsburgh, Pa.

[21] Appl. No.: 167,954

[22] Filed: Jul. 14, 1980

[51] Int. Cl.[3] ..... H01F 7/08

[52] U.S. Cl. ..... 335/256; 335/266

[58] Field of Search ..... 335/256, 266, 267, 255, 335/258

[56] References Cited

U.S. PATENT DOCUMENTS

| | | | |
|---|---|---|---|
| 707,967 | 8/1902 | Griscom | 335/256 |
| 3,406,338 | 10/1968 | Benbow | 324/103 |
| 3,900,822 | 8/1975 | Hardwick et al. | 335/256 |
| 4,050,020 | 9/1977 | Germer et al. | 324/116 |
| 4,128,807 | 12/1978 | Halstead et al. | 324/116 |

OTHER PUBLICATIONS

"Electromagnetic Devices" by H. C. Roters, John Wiley and Sons, 1941 pp. 242 and 290–306.

*Primary Examiner*—Harold Broome

*Attorney, Agent, or Firm*—D. R. Lackey

[57] ABSTRACT

A high efficiency bistable tractive solenoid device includes a magnetic housing having an interior cylindrical wall supporting stacked electromagnetic parts including a pair of coils and plural end pole pieces having inner diameters which are concentrically arranged to define a center bore. A double-acting plunger has an armature which is received by the center bore and is terminated by shaft ends having reduced diameters and being journalled for sliding movement in end plates also assembled within the housing interior wall with one of the shaft ends carrying a cam having a detent for latching the plunger in place.

6 Claims, 6 Drawing Figures

TRACTIVE SOLENOID DEVICE

CROSS-REFERENCE TO RELATED APPLICATIONS

This invention is related to application Ser. No. 167,952, for an Improved Clutch Mechanism For Time Of Day Watthour Meter Registers and application Ser. No. 167,953, for a Convertible Multirate Dial Register For Energy Consumption Meters, both filed concurrently with this application and assigned to the assignee of this invention.

BACKGROUND OF THE INVENTION

This invention relates to solenoid devices and more particularly to an improved tractive solenoid device having a double acting plunger activated by momentary electrical signals to initiate and latch two predetermined push-pull camming operations.

When tractive solenoids are used in certain applications as a controlled actuating device, certain design considerations become critical including a compact size, minimum weight, ease of mounting, required electrical power for operation, while maintaining reliability, ease of manufacture and minimum cost. The present invention is directed to such a tractive solenoid device in which the design and construction thereof is to provide a predetermined force by a solenoid plunger which is operated in opposite directions and is to travel through a predetermined stroke length. In one contemplated application, the plunger operation of a tractive solenoid is required when used to control a clutch mechanism included in a dial gear train of a multirate dial register used in electric energy billing meters. The close relationships of a large number of shaft mounted gear trains and associated clutch mechanisms are required for driving as many as three different sets of dial indicators in a single register. These close relationships of the register parts severely limit the available space for mounting and operating a solenoid device used as an actuator in a clutch operating arrangement. Examples of prior art solenoid devices used in multirate and multi-dial registers for electric energy meters are disclosed in the above cross-referenced copending applications Ser. Nos. 167,952 and 167,953, and also in U.S. Pat. No. 4,128,807 issued Dec. 5, 1978 and assigned to the assignee of this invention. A further example of a solenoid device used in multirate meter registers is disclosed in U.S. Pat. No. 4,050,020.

SUMMARY OF THE INVENTION

A bistable tractive solenoid device made in accordance with the present invention includes an elongated magnetic housing having straight sides for ease of mounting and an interior cylindrical wall bored close to the housing exterior sides so as to have a maximum diameter. A pair of coils are carried between outer and inner hollow magnetic end pole pieces in a stacked relationship within the housing interior wall. Non-magnetic end plates including center bearing openings are retained at the ends of the housing to terminate and hold the concentric hollow stack arrangement in place. The hollow centers of the stacked electromagnetic parts define a center bore for receiving the double acting plunger. The plunger armature section is supported within the center bore by small diameter shaft ends extending from the armature section and being journalled in the bearing surfaces of the center openings of the end plates. The plunger shaft ends are journalled in the bearing openings for supporting the plunger sliding movements in opposite directions as well as precisely maintaining a cylindrical armature air gap.

A cam including a frusto-conical shaped inclined surface is carried on one shaft end cosely adjacent one of the end plates to provide the maximum cantilevered support of the cam when it is in an extended position. The cam configuration includes large and small cylindrical surfaces adjacent the base inner end and outer end, respectively, of the inclined surface. The large cylindrical cam surface has a diameter slightly less than that of the large diameter base of the inclined cam surface to form a cam detent. Upon momentary energization of one of the solenoid coils, the plunger is electromagnetically shifted to the cam extended position. The cam inclined surface pushes a spring biased cam follower to a predetermined lifted position when the cam follower is positioned beyond the base of the inclined cam surface whereupon it is biased into the cam detent. Both the plunger and the cam follower are maintained in a mutually latched state by the cam detent. The cam is pulled from the cam follower when the other solenoid coil is momentary energized to initially remove the cam follower from the cam detent and return the follower to its initial operative condition. Annular stop surfaces at the ends of the plunger armature engage and abut the opposite end plates to terminate the bidirectional travel of the plunger and establish the limits of a predetermined required stroke thereof. Concurrently, the length between the end stop surfaces provides predetermined positioning of the released and nonengaged armature end relative to the next solenoid coil to be energized. Efficient and compact design of the solenoid electromagnet parts uniquely produces high levels of plunger force with low levels of electrical power input to the solenoid coils.

These and other features and advantages of the present invention will be apparent from the detailed description of the preferred embodiments shown in the drawings which are briefly described hereinafter.

DESCRIPTION OF THE PREFERRED EMBODIMENTS

Figure 1:
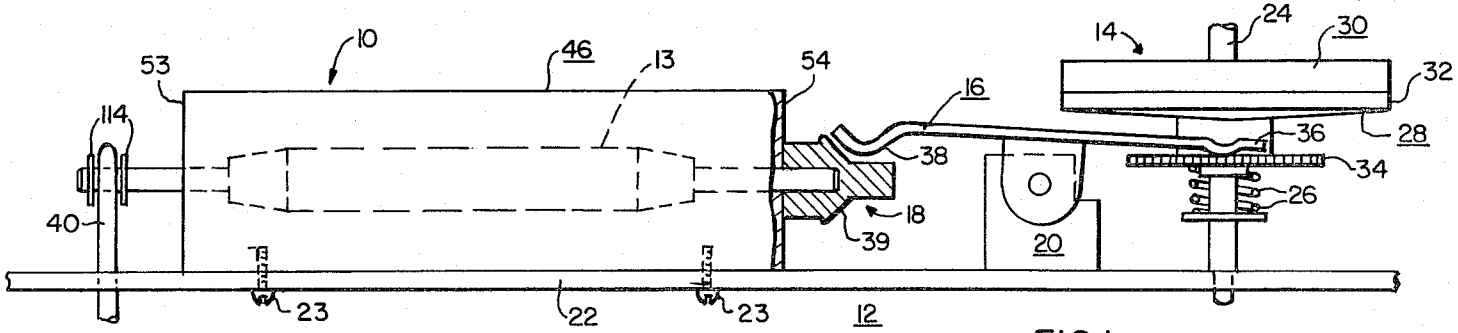
FIG. 1 is a fragmentary view of a multirate dial register for an electric energy billing meter having a solenoid device made in accordance with the present invention.

Referring now to the drawings, there is shown in FIG. 1 a solenoid device 10 made in accordance with the present invention. The solenoid device 10 is shown in one intended use in a multirate dial register 12 described and detailed in the above cross-referenced application Ser. No. 167,953; however, the present invention is not intended to be limited to such use. As noted in the aforementioned application, the solenoid device 10 provides reciprocating linear movement of a plunger 13 (described in detail hereinbelow) for providing actuation of a clutch operating arrangement. A bistable clutch actuator operation is provided for effecting opening and closing or coupling and uncoupling of a clutch mechanism 14 which is made as described in detail in the above cross-referenced application Ser. No. 167,952. A trip lever arm 16 provides clutch operation in response to the bidirectional movements of a cam 18 also forming an important feature of the solenoid device 10 as described in detail hereinbelow. The cam 18 is carried on one end of the plunger 13 as shown in FIG. 1.

The solenoid device 10 and a pivot 20 carrying the lever arm 16 are commonly mounted on the rearward side of a middle plate 22 of the register 12. One flat side of the solenoid device 10 is held against the flat middle plate 22 by a pair of threaded fasteners 23. The middle plate 22 also carries one end of a clutch shaft 24. The clutch mechanism 14 is mounted on the shaft 24 and generally includes a coil spring 26 for biasing a clutch driven part 28 which is slidably mounted on the shaft 24. The clutch part 28 is biased toward a clutch driving part 30 for engagement along clutch torque transmitting surfaces 32. An output gear 34 included in the clutch part 28 is engaged by forked tines 36 of a driven end of the lever arm 16. The driving end of the lever arm 16 includes a convexly curved cam follower end 38 biased into engagement with the cam 18 by the clutch spring 26. The follower 38 is lifted and lowered, as described more fully hereinbelow, as it rides over a frusto-conical inclined surface 39 of the cam 18.

Figure 3:
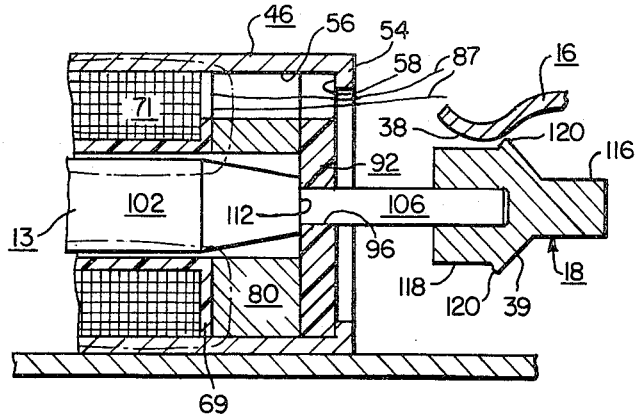
FIG. 3 is a fragmentary view of one end of the solenoid device shown in FIG. 2 when the device is moved to a different operative position.

At the other and lefthand end of the solenoid device 10, as shown in FIG. 1, is a connecting lever wire 40 forming part of an on-off dial status indicating mechanism being actuated between two states by the reciprocal travel of the solenoid plunger 13. In the cam retracted position of the device 10 shown in FIG. 1, one bistable state of the device is provided so that the cam follower 38 is lowered and the clutch spring 26 effects the clutch closed and coupling condition at the clutch mechanism 14. This coupling state is effected to render a gear train, not shown, including the clutch mechanism 14 to be effective for an on-measuring condition at one of an associated set of dial indicators, also not shown. Thus, the dial status indicating mechanism including the lever wire 40 assumes an on indicating position in FIG. 1. The other position of the solenoid device 10, described more fully hereinbelow in connection with the description of FIG. 3, is a cam extended position whereupon the cam follower 38 is in its arcuately pushed and clockwise lifted position about the pivot 20 to force the clutch part 28 toward the plate 22 and thereby open the clutch mechanism 14 at the surfaces 32 so that it is in the uncoupling state. When the clutch mechanism is open and interrupted or off, a non-measuring condition is provided at the above-mentioned associated set of dial indicators. Correspondingly, the wire lever 40 is moved from a lefthand-most position as shown in FIG. 1 to a righthand-most position to assume an "off" indicating position for the remaining parts of the dial status indicating mechanism, not shown.

Figure 2:
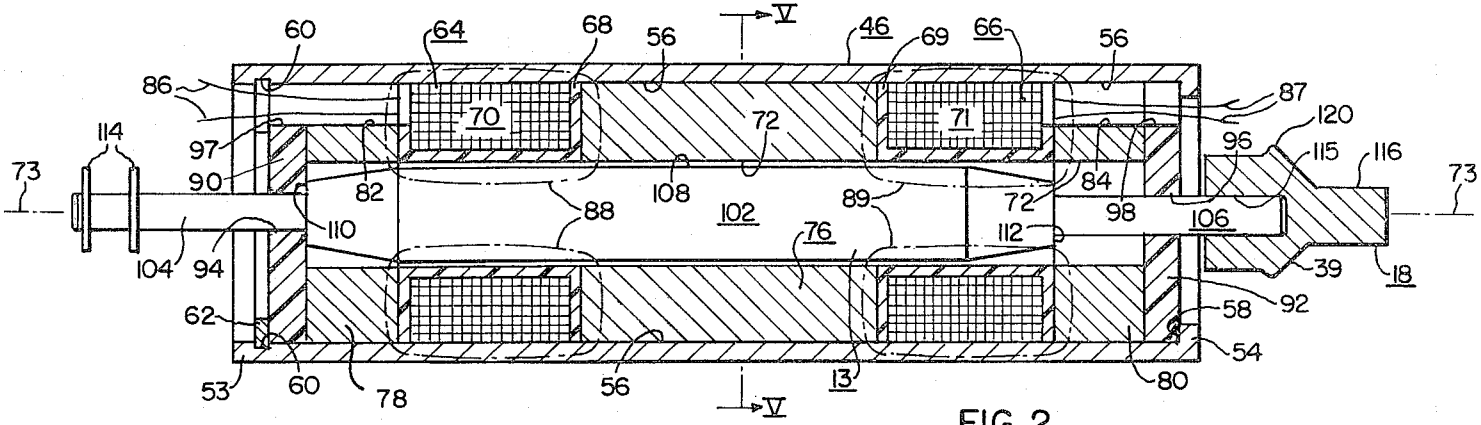
FIG. 2 is an enlarged side sectional view of the solenoid device shown in FIG. 1.

Having described the general purpose and function and one exemplary mounting arrangement of the solenoid device 10 in connection with the description of FIG. 1, the novel construction and other details of the solenoid device 10 are made hereinafter with reference to FIG. 2 illustrating the solenoid device 10 in a side sectional view. An elongated housing 46 is shown having four substantially equal flat rectangular parallel sides 48, 49, 50 and 51 shown in FIGS. 4 and 5 defining substantially square ends and a square cross-section. The side 51 includes internally threaded holes for receiving the screw fasteners 23. The housing lefthand and righthand ends 53 and 54 are substantially parallel and perpendicular to the sides so as to define a generally rectangular box configuration of the housing 46. The housing 46 is made in one preferred embodiment from square bar stock type 1018 soft magnetic cold rolled steel material. By way of example and not limitation, the dimensions of the housing 46 include an overall length in the order 1.6 inch (4 cm) and the four sides 48, 49, 50 and 51 are each in the order of 0.53 inch (1.35 cm).

Figure 4:
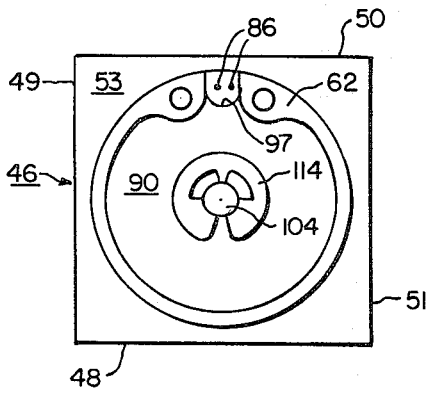
FIG. 4 is an end elevational view of the lefthand end of the solenoid device shown in FIGS. 1 and 2.
Figure 5:
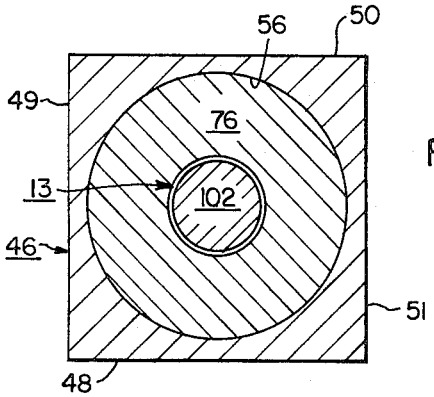
FIG. 5 is cross-sectional view of the solenoid device taken along the axis V—V in FIG. 2 and looking in the direction of the arrows.

A large diameter, in the order 0.516 inch (1.31 cm), in one preferred embodiment, interior cylindrical wall 56 is bored into the housing end 53 and terminates slightly short of the housing end 54. A slightly smaller diameter hole extends through the remaining portion of the housing end 54 providing a retainer end wall portion 58 formed by a radially inward annular lip. A circular groove 60 is recessed into the housing interior wall 56 adjacent the housing end 53 to receive a removable retainer ring 62 formed by a snap ring having slightly spaced ends as shown in FIG. 4. The removable retainer ring 62 cooperates with the retainer end wall 58 to secure the electromagnetic parts and end supports therefor within the housing interior wall 56 as described further hereinbelow. Alternatively, the interior cylindrical wall 56 can extend through the housing end 54 and a groove can be provided in the wall 56 corresponding to the groove 60 for receiving a second removable retainer ring such as retainer ring 62.

A pair of substantially identical magnetic flux producing solenoid coils is formed by a first coil 64 and a second coil 66. Nylon plastic bobbins 68 and 69 carry the coil windings 70 and 71 of the first and second coils 64 and 66, respectively. The outer diameters of the bobbins 68 and 69 are circular to form a close sliding fit with the housing interior wall 56. The bobbins are hollow and have inner diameters with a common and precise predetermined dimension defining axially spaced portions of a center and armature receiving bore 72. The center bore 72 is circular and cylindrical and extends uniformly along the center bore longitudinal axis 73 of the housing 46 for receiving the plunger 13 in coaxial alignment therewith for reciprocally sliding movement along the axis 73.

A hollow cylindrical inner magnetic end pole piece 76 is made of the same soft magnetic material type 1018 cold rolled steel as is the housing 46. The inner end pole piece 76 is positioned in the middle of the housing interior wall 56 and immediately between the first and second coil 64 and 66 to provide a common end pole piece for each of the coils. The outer diameter of the inner end pole piece 76 is also slidably fitted along the housing interior wall 56 and has an inner diameter having the same diameter as the coil bobbins 68 and 69 so as to be coextensive therewith in forming the middle section of the center bore 72. Thus formed and positioned in the housing 46, the inner end pole piece 76 as well as the radially outward mating areas of the housing 46 form magnetic flux paths noted further hereinbelow for the magnetic fluxes developed at the inner radial ends of both of the first and second coils 64 and 66. It is noted that the sides of the coil bobbins 64 and 66 and the sides of the inner end pole piece 76 are flat and parallel so that they are mountable in a closely stacked and contiguous relationship as shown in FIG. 2.

A pair of outer end pole pieces is formed by first and second pole pieces 78 and 80 formed of the same soft magnetic hollow cylindrical material as forming the inner pole piece 76 and the housing 46. The outer end pole pieces are substantially identical to each other and have the same inner and outer diameters as the piece 76 has. Thus, the pole pieces 76, 78 and 80 can be formed by cutting each from a common hollow cylindrical stock material. In one preferred embodiment, the outer end pole pieces 78 and 80 are about one-fourth the length of the inner end pole piece 76 and in the order of 0.125 inch (0.32 cm) when the pole piece 76 is in the order of 0.5 inch (1.3 cm). The first and second outer end pole pieces 78 and 80 abut in a flush contacting manner, the outer ends of the first and second coils 64 and 66, respectively. The outer diameters of the pole pieces 78 and 80 are slidably received by the housing interior wall 56. The inner diameters of the first and second outer end pole pieces 78 and 80 are precisely centered about the center bore axis 73 to complete the outer axial ends of the center bore 72 by being coextensive with the inner diameters of the coil bobbins 68 and 69 and the inner end pole piece 76. Axial notches or slots 82 and 84 are formed into the circumference of the end pole pieces 78 and 80, respectively, and are indicated at the tops thereof as viewed in FIG. 2. The slots 82 and 84 provide passages for pairs of winding leads 86 and 87 exiting the housing 46 from the coil windings 70 and 71, respectively.

As described hereinabove, the stationary electromagnetic parts of the solenoid device 10 include the inner end pole piece 76, the first and second coils 64 and 66, the first and second outer end pole pieces 78 and 80 and the radially adjacent portions of the housing 46 when the aforementioned parts are arranged in the stacked relationship within the housing interior wall 56 as shown in FIG. 2. The pairs of broken lines 88 and 89 represent the mean magnetic flux paths for the magnetic fluxes produced by the first and second coils 64 and 66, respectively, and the paths include the plunger 13 as described in more detail hereinbelow. As noted above, a pair of threaded holes, not shown, are drilled and topped in the housing side 51 to receive the pair of threaded fasteners 23.

To complete the stationary stacked parts within the housing interior wall 56 of the solenoid device 10, a pair of end plates defined by the first and second end plates 90 and 92 made of flat discs of a nylon plastic bearing material are provided in one preferred embodiment. The non-magnetic first and second end plates 90 and 92 have an outer diameter for slidably fitting within the housing interior wall 56 and fit in flush contact with the outer sides of the first and second outer end pole pieces 78 and 80 as also shown in FIG. 2. Center circular bearing openings 94 and 96 are formed in the center of each of the end plates 90 and 92, respectively. The bearing openings have the same diameter and are accurately formed in the center of the end plates wherein the diameters are substantially reduced from that of the diameter of the center bore 72. The bearing openings 94 and 96 are each coaxially aligned with each other about the center axis 73 when mounted. The outer circumference of the end plates include axial slots 97 and 98 substantially the same width and radial depth as the slots 82 and 84 and are coextensive therewith to provide the remaining portions of the passages for the pairs of terminal leads 86 and 87, respectively, for connecting the pairs of leads to a source of electrical energization for the coil windings 70 and 71.

Having described the stationary parts supported in the housing interior wall 56 in the horizontally stacked relationship as noted hereinabove, the stationary parts are easily assembled to the housing and are held in tightly stacked relationship by the removable retainer ring 62 and the retainer end wall 58 or alternatively a second removable retainer ring such as the ring 62 at the housing end 54. As also noted hereinabove, the stacked assembly of the housing interior stationary parts uniquely form the armature receiving center bore 72 precisely centered about the center axis 73. Additionally, the center bearing openings 94 and 96 of the first and second end plates 90 and 92, respectively, are positioned for accurately supporting the ends of the plunger 13 so that the middle portion thereof is accurately positioned within the center bore as described more fully hereinafter. Further advantageously, the widely spaced relationship of the two end plates 90 and 92 provides widely spaced bearing support of the plunger ends to prevent cocking or tilting of the plunger 13 as forces from the cam follower 38 are directed with components thereof being perpendicular to the longitudinal axis of the plunger 13.

Referring now in more detail to the construction of the plunger 13 shown in FIG. 2, the plunger 13 includes an elongated cylindrical shape made of a soft magnetic material, for example type 1010 cold rolled steel, and is formed from a stock cylindrical rod material. The plunger 13 is formed with a middle armature section 102 which is terminated by opposite shaft ends 104 and 106 extending from the ends of the armature section about substantially reduced circumferences having equal diameters. The straight cylindrical sides of the armature section 102 are formed, with a diameter of 0.245 inch (0.62 cm) in one form thereof, so as to provide a minimum uniform cylindrical air gap 108, in the order of 0.005 inch (0.013 cm), for example, between the circumference of the armature section 102 and the circumscribing area of the center bore 72 formed by the above-described stacked electromagnetic parts supported within the housing interior wall 56. The substantially identical plunger shafts 104 and 106 have diameters in the order of 0.07 inch (0.18 cm) for example, when journalled for reciprocating sliding movements in the bearing openings 94 and 96. The air gap 108 is accurately maintained by the straight coaxially aligned shaft ends 104 and 106 of the plunger 13 having a close journalled support within the end plate center bearings 94 and 96. The ends of the armature section 102 are tapered inwardly as shown in FIG. 2 for a length approximately one-half the length of the solenoid coils 64 and 66. The ends of the armature section 102 terminate at stop surfaces 110 and 112 formed by the radially disposed annular shoulders extending outwardly from the inner ends of the smaller diameter plunger shaft ends 104 and 106, respectively. The length of the armature section between the surfaces 110 and 112 is about 1.25 in. (3.2 cm). Abutment of the stop surface 110 with the end plate 90 terminates the cam retracting travel of the plunger 13 in the position shown in FIG. 2. This is effected, of course, by momentary energization of the winding 70 of the first coil 64 through the pair of winding terminal leads 86. Abutment of the stop surface 112 with the end plate 92 terminates the cam extending travel of the plunger 13 as shown in FIG. 3. The bidirectional travel length is in the order of 0.15 inch (0.38 cm), for example. The position of the armature 13 in FIG. 3 is provided by energization of the winding 71 of the second coil 66 when energized through the pair winding terminal leads 87.

Thus, the end plates 90 and 92 provide abutment surfaces as well as providing bearing support for the plunger 13 and end support of the stacked electromagnetic parts assembled to the housing interior wall 56. As also noted hereinabove, the wide spacing of the end plates prevents tilting of the plunger 13 as it is supported to accurately maintain a minimum air gap 108 in the center bore 72 as the plunger 13 pushes against the cam follower 38. The predetermined axial length of the electromagnetic parts including the first and second coils 64 and 66 and the opposite end pole pieces 76, 78 and 80 of coils are arranged so as to form the center bore 72 with a predetermined axial length correlated to the axial length of the plunger armature 102. The center bore 72 length is such that when one of the armature stop surfaces 110 or 112 abuts the adjacent end plate 90 or 92, respectively, the opposite armature end is positioned to be generally co-aligned with the end of the associated coil. The co-aligned positioning produces maximum magnetic moving effectiveness upon the plunger 13 when the circumscribing coil associated therewith is energized.

The exterior portions of the plunger shaft extensions or ends 104 and 106 carry the cam 18 and mounting of the lever wire 40 of a dial status indicating mechanism, not shown, as noted hereinabove. A pair of grooves 113, shown in FIG. 6, in the shaft end 104 receive a pair of snap rings 114 to secure the connecting wire 40 to the shaft end 104. The diameter of the shaft end 106 at the outer end is reduced slightly to form an interference fit and end abutment with an inner axial bore 115 of the cam 18 receiving the end of the shaft 106 as shown in FIG. 2. The cam 18 is mounted to the shaft end 106 so that in the cam retracted position of the plunger 13, the cam is supported immediately adjacent the outer side of the end plate 92 to provide the closest cantilevered support possible of the cam 18 as it is pushed against the spring biased force of the cam follower 38 in its cam extended position of FIG. 3.

The cam 18 has a configuration including the frusto-conical inclined surface 39 as noted hereinabove which extends radially outward at an angle of approximately forty five degrees from an axially outward small diameter cylindrical top end 116 to an axially inward larger diameter cylindrical surface 118. The radially outward cylindrical surface 118 is slightly recessed from a detent rim 120 forming the largest diameter base of the inclined surface 39 and having the maximum circumference of the cam 18 configuration so that the rim 120 extends radially beyond the larger cam cylindrical surface 118. The outward travel of the plunger 13 from the retracted position in FIG. 1 to the extended position in FIG. 2 pushes the cam 13 against the cam follower 38. Forced lifting of the follower 38 as it travels along the inclined surface 39 effects the pivoting movement to open the clutch mechanism 14 as described hereinabove. Upon the follower 38 riding over the detent rim 120, the plunger 13 is latched from retracting since the follower 38 is biased against the larger cam cylindrical surface 118 and against the annular radial and interfering side of the detent rim 120 as shown in FIG. 3. Abutment of armature stop surface 112 and end plate 92 latch further extending movement. Thus, the follower 38 is maintained in place, as is the extended position of the plunger 13, so that any vibrations or other extraneous mechanical forces cannot move the plunger 13 toward the retracted position to cause the cam 18 to be withdrawn from the cam follower 38. The foregoing description of the plunger extention occurs upon the first coil 64 being energized.

When the plunger 13 is in the cam extended position shown in FIG. 3, the energization of the winding 70 of the first coil 64 generates the magnetic flux having the mean path shown by the broken lines 88 and the armature section 102 is pulled toward the coil 64 and travels toward the end plate 90 until the stop surface 110 engages the area of the end plate adjacent the bearing opening 94. The axial force magnetically produced upon the plunger 13 is sufficient to pull the detent rim 120 past the cam follower 38 to overcome the interference to movement provided by the detent rim 120 and the spring bias force on the cam follower. Thereafter, the cam follower 38 rides down the frusto-conical inclined surface 39 and reaches the cam smaller diameter cylindrical surface 116 after the momentary energization of the coil winding 70 and abutment of the plunger stop surface 110 with the plate 90. The plunger 13 is latched and maintained in the cam retracted position and the cam follower 38 is maintained in the lowered pivoted position since the follower is biased against the smaller diameter cam cylindrical surface 116 adjacent the radially outwardly extending inclined cam surface 39. Any vibrations or extraneous mechanical forces tending to move the plunger 13 to the extended position, to the right as viewed in FIG. 1, are restrained. Effectively the plunger 13 is clamped against movement when in the one and retracted position by the armature end stop surface 110 abutting the end plate 90 and against movement toward the opposite and extended direction by the follower 38 being clamped against the surface 116 and outwardly adjacent the inclined cam surface 39.

To effect the plunger travel from the retracted to the extended positions, the latter position being shown in FIG. 2, the winding 71 of the second coil 66 is energized through the pair of terminal leads 87, as noted above, to produce the magnetic flux having the mean path represented by the broken lines 80 to develop the magnetic force for forcing the plunger end 106 to the cam extended position. The cam follower lifting operation is provided as also described hereinabove to also effect the mutual plunger and cam to cam follower latched conditions described immediately hereinabove. The two latched conditions assumed by the opposite limits of travel by the plunger 13 in the cam extended and cam retracted positions thereof following the momentary electrical energizations of the coil 66 and 64, respectively, provides the bistable and two fixed conditions or states of the plunger 13 and the cam follower 38 when not being energized and activated. Concurrently, the opposite plunger shaft end 106 carrying the lever wire 40 between the pair of shaft snap rings 114 is maintained in either the "off" or the "on" indicating state when the plunger is in one of the two bistable or at rest conditions.

Figure 6:
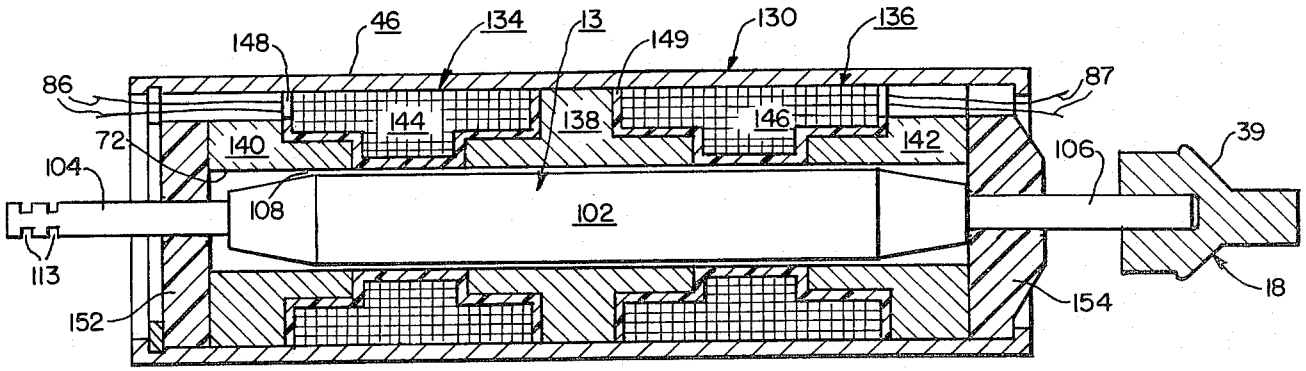
FIG. 6 is a side sectional view corresponding to the side sectional view in FIG. 2 for illustrating an alternative embodiment of a solenoid device made in accordance with the present invention and replacing the solenoid device shown in the arrangement of FIG. 1.

FIG. 6 illustrates an alternative embodiment of a solenoid device 130 having substantially the same overall size and operation but provides additional plunger force for replacing the solenoid device 10 in FIG. 1 so as to maintain the same exterior size by using the same housing 46 and the same plunger 13. The solenoid device 130 carries the same cam 18 and includes the pair of grooves 113 for receiving the same snap rings 114 to clamp the lever wire 40 therebetween as shown in FIG. 2. The same plunger 13 is included in the solenoid device 130 and other parts that are the same as in the solenoid device 10 are designated by the same numerals. The solenoid device 130 device produces greater or additional bidirectional force or thrust on the double-acting plunger 130 acting through the same stroke length. The first and second coils 134 and 136 replace the pair of coils 64 and 66. The inner end pole piece 138 replaces the inner end pole piece 76 and the two outer end pole pieces 140 and 142 replace the pair of outer end pole pieces 78 and 80. The pole pieces in the solenoid device 130 are made of the same hollow soft magnetic materials as are the pole pieces in the solenoid device 10 except they are shaped differently as shown in FIG. 6. The inner diameters of the stacked electromagnetic parts of the device 130 in the housing 46 form the same center bore 72.

The aforementioned electromagnetic parts of the device 130 have adjacent complementary side fitting relationships to also have a stacked relationship as shown supported within the housing interior wall 56. The windings 144 and 146 are wound on plastic bobbins 148 and 149 of the coils 134 and 136. The radially outward areas of the bobbins have a longer axial length than the inner radial areas adjacent the center bore 72. In a reverse complementary fashion, the circularly hollow pole pieces 138, 140 and 142 have a longer axial length adjacent the center bore 72 and a narrower or shorter axial length radially outward adjacent the housing interior wall 56. Thus, the inner end pole piece 138 has a radially inward hollow cylindrical portion extending in opposite axial directions defining a half cross-sectional shape in the form of an inverted T in the middle of the housing 46 as shown in FIG. 6. The outer end pole pieces 140 and 142 have radially inward hollow cylindrical portions extending axially inward defining a half cross-sectional configuration resembling an L-shaped and a reversed L-shaped, respectively, as also shown in FIG. 6. The additional axial length at the outer radial portions of the coils 134 and 136 allows an increased number of winding turns to be included in the windings 144 and 145 than are provided in the windings 70 and 71 in the coils 64 and 66 of the solenoid device 10. The additional number of winding turns provides additional ampere-turns to be developed by the coils 134 and 136 than are developed by the coils 64 and 66 so that increased magnetic thrust or force may be applied to the armature section 102 of the plunger 13 at limited levels of electrical power input available for input to the solenoid device 130. The pole piece configurations of the solenoid device 130 permit the use of additional winding turns while still directing the higher flux levels through the armature air gap 108 with high efficiency as they are directed through into armature section 102 to effect the magnetic thrust thereon.

Modified first and second end plates 152 and 154 replace the first and second end plates 90 and 92, respectively, of the solenoid device 10. The end plates 152 and 154 are made of brass and are slightly thicker but have the same size center bearing openings 156 and 158 as provided in the bearing openings 94 and 96. The end plates 152 and 154 also can be made of a plastic bearing material. The width of the end plate 154 is axially longer radially adjacent the bearing opening 158 to provide additional bearing length at the bearing support of the plunger shaft end 106 carrying the cam 18 and subjected to the aforementioned bias forces from the cam follower tending to tilt the plunger 13. The larger bearing area of opening 158 affords more bearing wear surface and greater stability.

In one embodiment of the solenoid device 130 each of the coil windings 144 and 145 include 1,231 turns of wire AWG size No. 37 (0.0045 inch, 0.011 cm). Each of the windings has a resistance in the order of sixty-four ohms. With a direct current input of twenty volts, the windings draw an average of three hundred twenty-five milliamperes. These relatively low levels of current are applied in a momentary or short pulse to develop the required magnetic thrust and stroke on the plunger 13 to produce the required cam actuation force in the order of seventy grams which is required in one form of the clutch operating arrangement shown in FIG. 1. The lower levels of voltage and current solenoid energization are required to accommodate the relatively low power outputs of electronic solenoid control circuits such as provided in solid state clock controlled circuits and electronic time of day electric energy metering circuits. Thus, the power or watt loss is minimized with efficient utilization of the coil fluxes.

The solenoid devices 10 and 130 described hereinabove and made in accordance with the present invention provide the uniquely efficient, compact, reliable and simple manufacturing design features as noted. It is contemplated that other modifications and alterations of the present invention may be made as are apparent to those skilled in the art without departing from the spirit and scope of this invention.

What is claimed is:

1. A tractive solenoid device comprising:

an elongated housing made of a soft magnetic material including interior cylindrical wall extending between the ends thereof;

an inner end pole piece made of a circularly hollow soft magnetic material slidably received and supported by said interior cylindrical wall and including an inner diameter defining the middle portion of an armature receiving center bore;

first and second substantially identical circular coil members slidably received and supported by said interior cylindrical wall adjacent the sides of said inner end pole piece and having inner diameters coextensive with said center bore;

first and second substantially identical outer end pole pieces each made of a circularly hollow soft magnetic material and slidably received and supported by said interior cylindrical wall adjacent the outer sides of said first and second coil members, respectively, and including inner diameters being further coextensive with said center bore to terminate said bore;

first and second non-magnetic circular end plate members slidably received and supported by said interior cylindrical wall adjacent the outer ends of said end pole pieces and extending radially inward to mutually aligned center bearing openings;

a pair of retainer members extending radially inward from at the ends of said housing for axially holding the outer sides of said end plate members in a mutually stacked relationship with the pole pieces and the coil members; and a double acting plunger member made of a soft magnetic material including a cylindrical armature section having a predetermined cylindrical air gap space with said center bore and having a predetermined axial length extending between radial stop surfaces terminating the armature section at radially inward ends carrying opposite shaft extension ends with said shaft ends being journalled for sliding support within said center openings of said first and second end plate members such that selective momentary energization of said first and second coil members axially slides said plunger member between opposite positions upon abutment of the armature section adjacent said first and second end plate members.

2. The tractive solenoid device as claimed in claim 1 wherein one of said opposite shaft ends of said plunger carries a cam having a substantially frusto-conical shaped inclined cam surface terminating at one cylindrical end in a diameter slightly less than the base diameter of said cam surface so that when one of said opposite positions of said plunger pushes said base of said cam beyond a cam follower member, a mutually latched state is effected between said plunger and the cam follower.

3. The tractive solenoid device as claimed in claim 2 wherein said cam has a detent rim formed at the base of said frusto-conical shaped inclined surface thereof and extending radially outward of said one cylindrical end thereof.

4. The tractive solenoid device as claimed in claim 3 wherein said cam member is positioned immediately adjacent said outer side of said second end plate when one of the armature section ends abuts in the inner side of said first end plate.

5. The tractive solenoid device as claimed in claim 1 wherein each of the armature section ends is positioned in substantially radial coalignment with the outer side of said first and second coil members when the other armature section end abuts the adjacent one of said first and second end plate.

6. The tractive solenoid device as claimed in claim 1 wherein said first and second coil members have a substantially longer axial length at the radially outward circumference than at the radially inward circumference, and further wherein said inner and said first and second outer end poles have substantially shorter axial lengths at the radially outwardly circumferences than at the radially inward circumferences so as to have flush interfitting side surfaces complementary to the opposite side surfaces of said first and second coil members.

* * * * *